US011688378B2

(12) United States Patent
Lee et al.

(10) Patent No.: US 11,688,378 B2
(45) Date of Patent: Jun. 27, 2023

(54) INTERLOCKING BLOCKS FOR BUILDING CUSTOMIZABLE RESONANT SOUND ABSORBING STRUCTURES

(71) Applicant: Toyota Motor Engineering & Manufacturing North America, Inc., Plano, TX (US)

(72) Inventors: Taehwa Lee, Ann Arbor, MI (US); Hideo Iizuka, Ann Arbor, MI (US); Ryohei Tsuruta, Ann Arbor, MI (US)

(73) Assignee: Toyota Motor Engineering & Manufacturing North America, Inc., Plano, TX (US)

( * ) Notice: Subject to any disclaimer, the term of this patent is extended or adjusted under 35 U.S.C. 154(b) by 405 days.

(21) Appl. No.: 16/945,286

(22) Filed: Jul. 31, 2020

(65) Prior Publication Data

US 2022/0036871 A1 Feb. 3, 2022

(51) Int. Cl.
*G10K 11/172* (2006.01)

(52) U.S. Cl.
CPC ..... *G10K 11/172* (2013.01)

(58) Field of Classification Search
CPC ..... G10K 11/172
USPC ..... 181/286, 224
See application file for complete search history.

(56) References Cited

U.S. PATENT DOCUMENTS

| | | | | |
|---|---|---|---|---|
| 7,963,362 | B2 * | 6/2011 | Lidoine | F02C 7/24 181/292 |
| 10,465,714 | B2 * | 11/2019 | Merchant | F04D 29/545 |
| 10,939,676 | B1 * | 3/2021 | Harter | E04G 5/10 |
| 10,957,298 | B2 * | 3/2021 | Yoon | G10K 11/16 |
| 11,046,098 | B2 * | 6/2021 | Umenai | B41J 29/13 |
| 11,204,185 | B2 * | 12/2021 | Wang | G10K 11/161 |
| 11,386,878 | B2 * | 7/2022 | Wang | E04B 1/86 |
| 2020/0000639 | A1 | 1/2020 | Almeflo | |
| 2020/0260880 | A1 * | 8/2020 | Nelson | A47C 19/005 |
| 2021/0074256 | A1 * | 3/2021 | Freiburghaus | G10K 11/172 |

FOREIGN PATENT DOCUMENTS

| | | | | |
|---|---|---|---|---|
| KR | 1422113 | B1 * | 7/2014 | E01F 8/0005 |
| WO | 2015092488 | A1 | 6/2015 | |

* cited by examiner

*Primary Examiner* — Forrest M Phillips
(74) *Attorney, Agent, or Firm* — Christopher G. Darrow; Darrow Mustafa PC

(57) ABSTRACT

Systems for building modular quarter-wavelength resonators, and arrays of said resonators, include interlocking blocks having channels in them. Different block varieties can include those having straight channels and those having curved channels, to facilitate assembly of resonators of any desired configuration. Resonator length, and therefore resonance frequency, can be easily designed by adjusting the number of blocks used for a particular resonator.

19 Claims, 10 Drawing Sheets

FIG. 2C
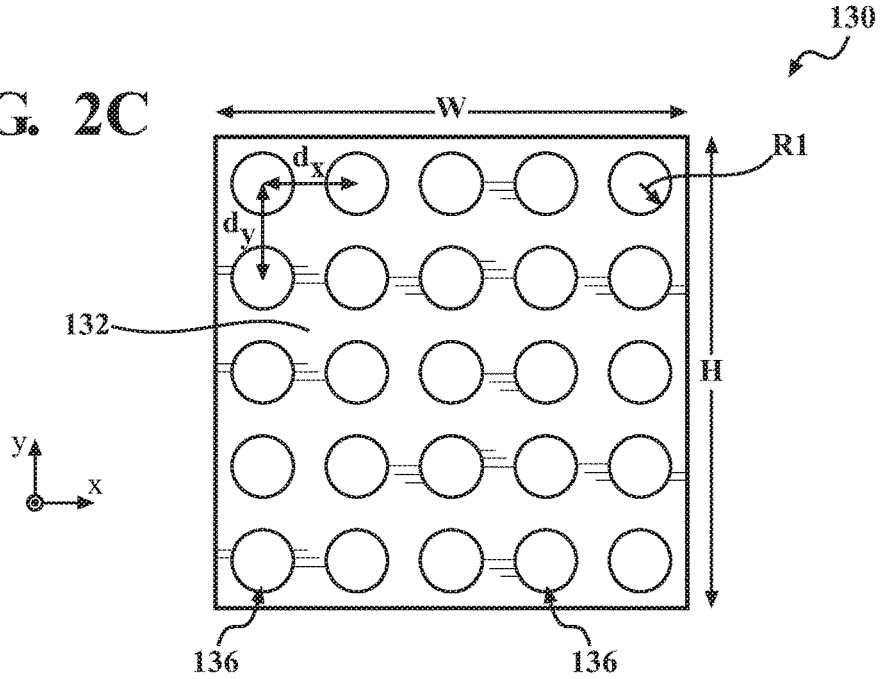
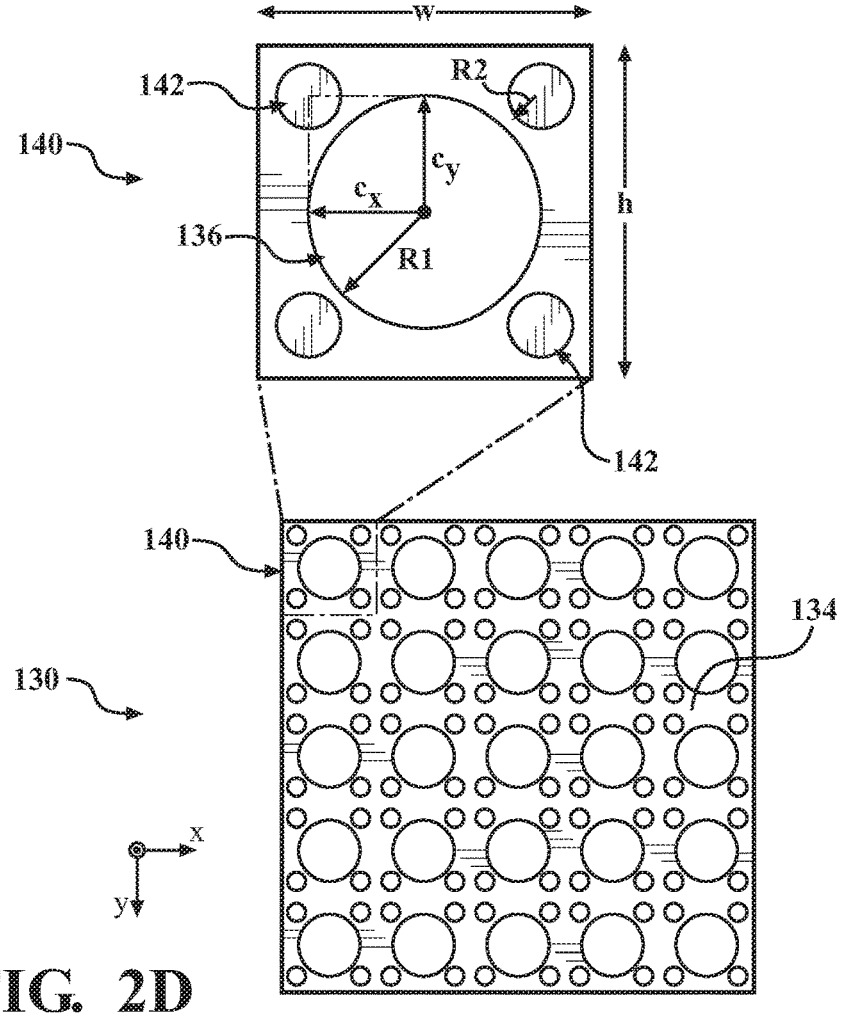
FIG. 2D

FIG. 7A
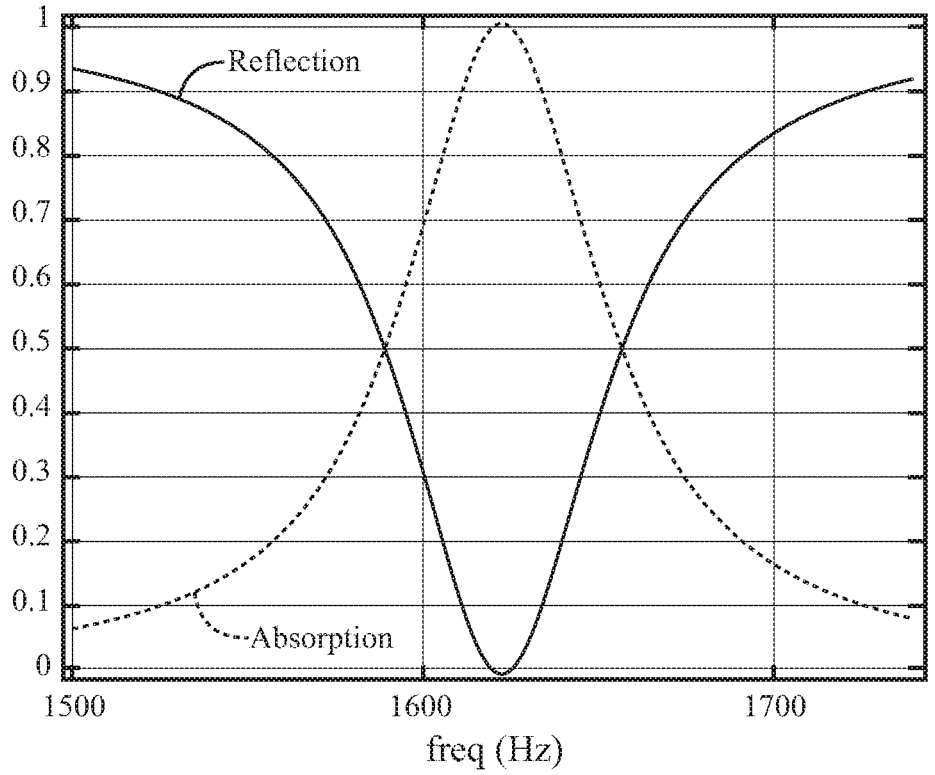
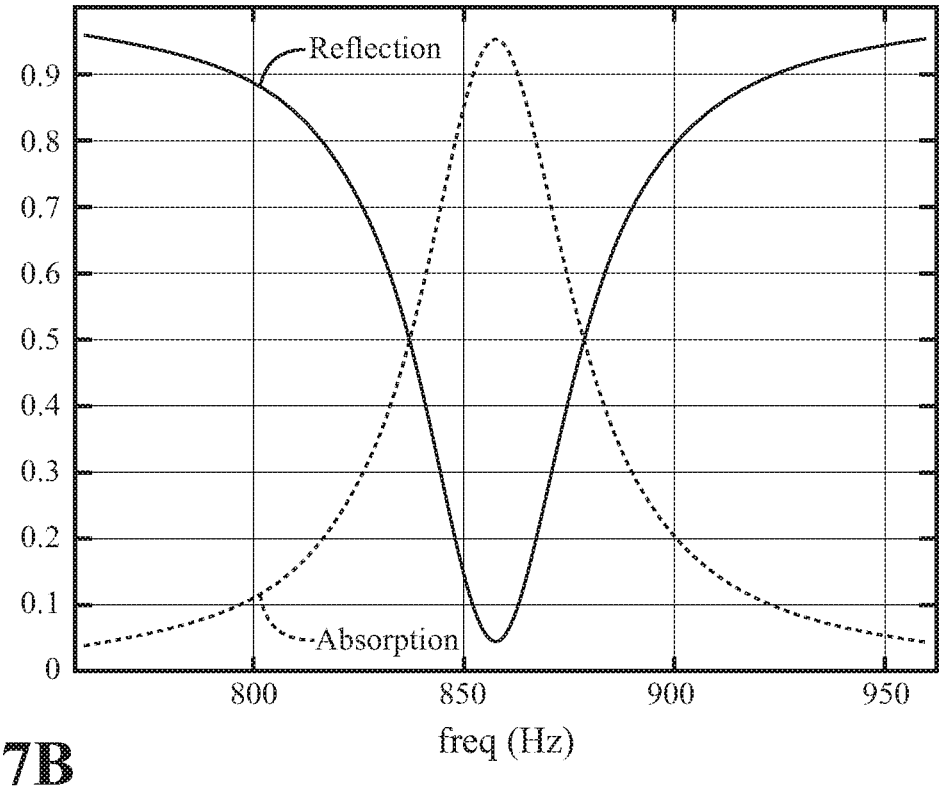
FIG. 7B

INTERLOCKING BLOCKS FOR BUILDING CUSTOMIZABLE RESONANT SOUND ABSORBING STRUCTURES

TECHNICAL FIELD

The present disclosure generally relates to resonant sound absorbers and, more particularly, to modular systems for building quarter-wavelength sound absorbers of varying frequency.

BACKGROUND

The background description provided herein is for the purpose of generally presenting the context of the disclosure. Work of the presently named inventors, to the extent it may be described in this background section, as well as aspects of the description that may not otherwise qualify as prior art at the time of filing, are neither expressly nor impliedly admitted as prior art against the present technology.

Quarter-wave, or tube, resonators can be used in a wide variety of applications for frequency specific sound absorption. These resonators consist of a tubular structure with an open and an opposite end wall, with a specified length between (the tube length). They resonantly absorb sound having wavelength that is four times the length of the tube. This is because sound of the resonant wavelength/frequency traverses half a wavelength when it enters the tube, reflects from the end wall, and emerges; the emerging sound wave is thus in destructive antiphase to incident sound of the same frequency.

In addition to variations in tube length/resonant frequency, quarter-wave resonators can have bends or other non-linear configurations. This can be useful in applications where space is limited. Conventional methods for building a quarter-wave resonator, such as injection molding, involve a fixed length and configuration such that, building resonators with different lengths and configurations requires multiple molds or other build parameters/equipment. Furthermore, once a resonator is built, reconfiguration (e.g. changing length or introducing a bend) to accommodate changing need, is non-trivial.

Accordingly, it would be desirable to provide a modular system for easily and rapidly building modular tube absorbers of a variety of desired lengths and configurations.

SUMMARY

This section provides a general summary of the disclosure, and is not a comprehensive disclosure of its full scope or all of its features.

In various aspects, the present teachings provide a modular acoustic sound absorber, having a plurality of tube resonators. Each tube resonator of the plurality of tube resonators includes one or more straight channel blocks, each having an exterior shape. Each straight channel block further includes a top surface having one or more first type connector elements; and a bottom surface, parallel to and opposite the top surface. The bottom surface includes one or more second type connector elements configured to engage with the one or more first type connector elements of an adjacent block. The straight channel block also includes one or more side surfaces connecting the top and bottom surfaces; and a straight channel forming apertures in the top and bottom surfaces and passing through an interior of the straight channel block. The straight channel thereby forms at least a portion of each tube resonator. Each tube resonator also includes one or more terminator blocks forming an end wall of each tube resonator.

In other aspects, the present teachings provide a modular quarter-wavelength resonator. The resonator includes one or more straight channel blocks having an exterior shape. Each straight channel block has a top surface including one or more first type connector elements; and a bottom surface, parallel to and opposite the top surface. The bottom surface includes one or more second type connector elements, configured to engage with the one or more first type connector elements. Each straight channel block also includes at least one side surface connecting the top and bottom surfaces; and a straight channel forming apertures in the top and bottom surfaces and passing through an interior of the straight channel block. The straight channel thereby forms at least a portion of the quarter-wavelength resonator. The quarter-wavelength resonator further includes a terminator block forming an end wall of the resonator.

In still other aspects, the present teachings provide a kit for assembling a modular, quarter-wavelength resonator. The kit includes a plurality of Type A blocks, a plurality of Type B blocks, and one or more Type C blocks. Each Type A block has a top surface with one or more first type connector elements; and a bottom surface, parallel to and opposite the top surface. The bottom surface includes one or more second type connector elements configured to engage with the one or more first type connector elements of an adjacent block. The Type A block also includes one or more side surfaces connecting the top and bottom surfaces; and a straight channel forming apertures in the top and bottom surfaces and passing through an interior of the Type A block. Each Type B blocks includes a top surface having one or more first type connector elements; and a bottom surface parallel to and opposite the top surface. The Type B block further includes a coupling side surface, connecting the top and bottom surfaces of the Type B block, and having one or more second type connector elements. The Type B block also includes a nonlinear channel forming apertures in the top surface and the coupling side surface, and passing through an interior of the Type B block. Each Type C block includes a top surface and a bottom surface opposite the top surface, and one or more first type connector elements on the top surface. Type A and Type B blocks are configured to be connected in series, the series capped with a Type C block. The capped series a quarter-wavelength resonator, with a combination of straight channels and nonlinear channels from the series forming a resonance chamber, with the top surface of the Type C block forming an end wall.

Further areas of applicability and various methods of enhancing the disclosed technology will become apparent from the description provided herein. The description and specific examples in this summary are intended for purposes of illustration only and are not intended to limit the scope of the present disclosure.

BRIEF DESCRIPTION OF THE DRAWINGS

The present teachings will become more fully understood from the detailed description and the accompanying drawings, wherein:

FIGS. 2C and 2D are top and bottom plan views, respectively, of the top plate of FIGS. 2A and 2B;

FIGS. 7A and 7B are plots of acoustic reflection and absorbance as a function of frequency for the tube resonators of FIG. 4A-4B and FIGS. 5A-5C, respectively.

It should be noted that the figures set forth herein are intended to exemplify the general characteristics of the methods, algorithms, and devices among those of the present technology, for the purpose of the description of certain aspects. These figures may not precisely reflect the characteristics of any given aspect, and are not necessarily intended to define or limit specific embodiments within the scope of this technology. Further, certain aspects may incorporate features from a combination of figures.

DETAILED DESCRIPTION

The present teachings provide systems for building modular quarter-wavelength acoustic resonators. Individual resonators, or arrays of resonators, can be built quickly and easily, and in a wide variety of configurations. In particular, resonator length—and therefore frequency—can be easily varied, and bends can be easily incorporated into individual resonators as well.

Systems of the present teachings include interlocking building blocks for the facile building of acoustic tube resonators of a desired resonance frequency and a desired architecture. Individual building blocks can include channels, or tube portions, that can be straight or curved.

Figure 1A:
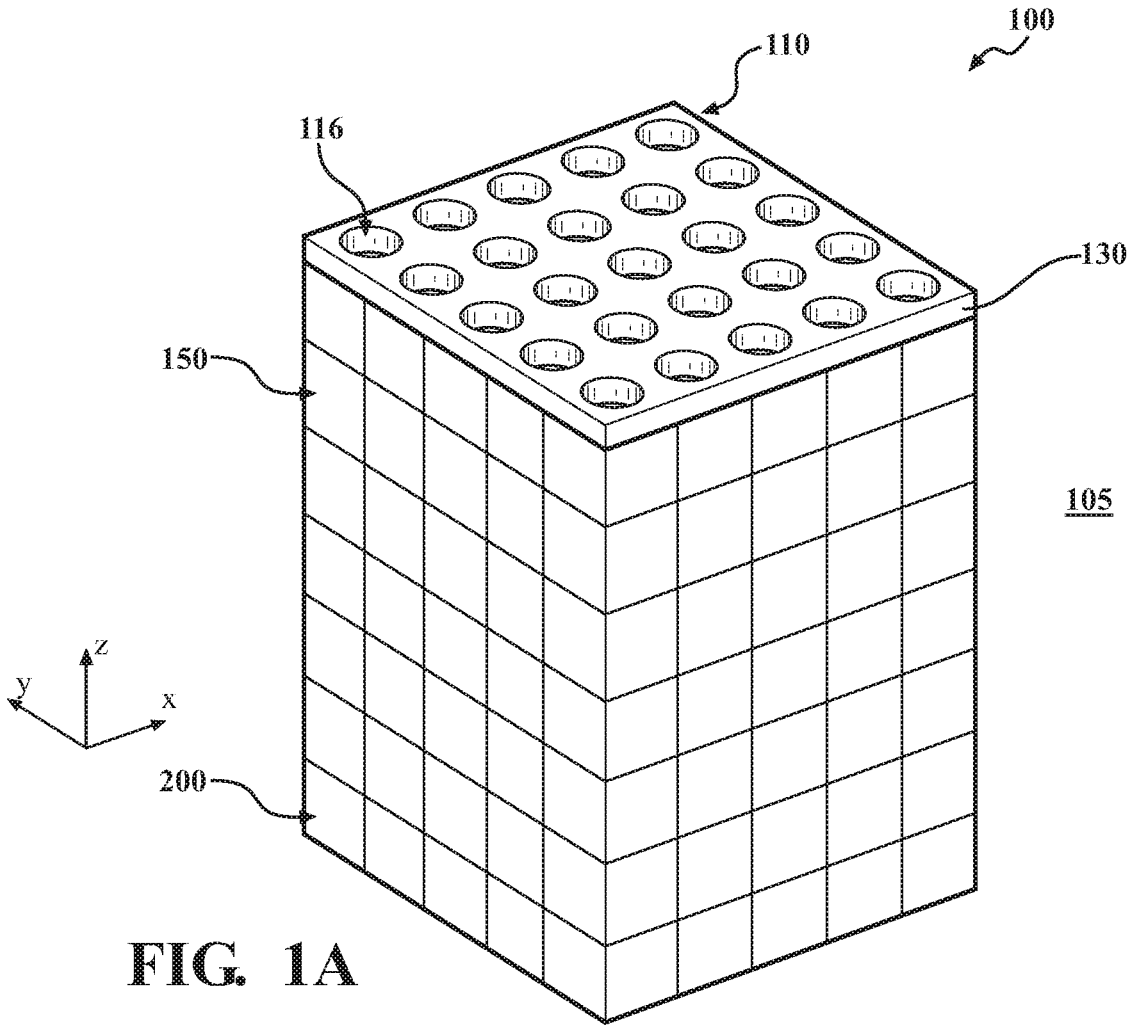
FIG. 1A is a perspective view of a modular structure having a 5×5 array of tube resonators.
Figure 1B:
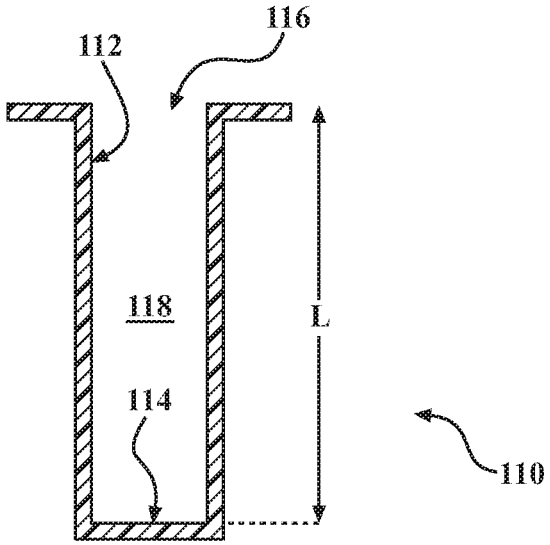
FIG. 1B is a schematic side cross-sectional view of a tube resonator of FIG. 1A.

FIG. 1A shows a perspective view of a broadband resonator array 100 having a 5×5 array of tube resonators 110 (referred to alternatively as quarter-wavelength resonators 110). The array 100 can be positioned in a fluid, sound conductive, ambient medium 105—typically, although not exclusively, air. Each tube resonator of the exemplary array 100 of FIG. 1A is built from seven layers of blocks (e.g. 150, 200), with a top plate 130. FIG. 1B shows a side cross sectional view of an individual tube resonator 110. The tube resonator 110 has at least one side wall 112, an end wall 114, and an open end 116, thereby defining and open-ended resonance chamber 118. The open-ended resonance chamber 118 has a length, L, defined as the distance from the open end 116 to the end wall 114. It will be understood that the tube resonator 110 has a resonance frequency, $f_0$, described by Equation 1:

$$f_0 = \frac{c}{4L}, \qquad \text{Eq. 1}$$

where L is as defined above, and c is the speed of sound in the ambient medium 105. As described more fully below, the length, L, and therefore resonance frequency, $f_0$, of each tube resonator 110 is adjustable by changing the number and configuration of blocks (e.g. 150) forming it.

Figure 2A:
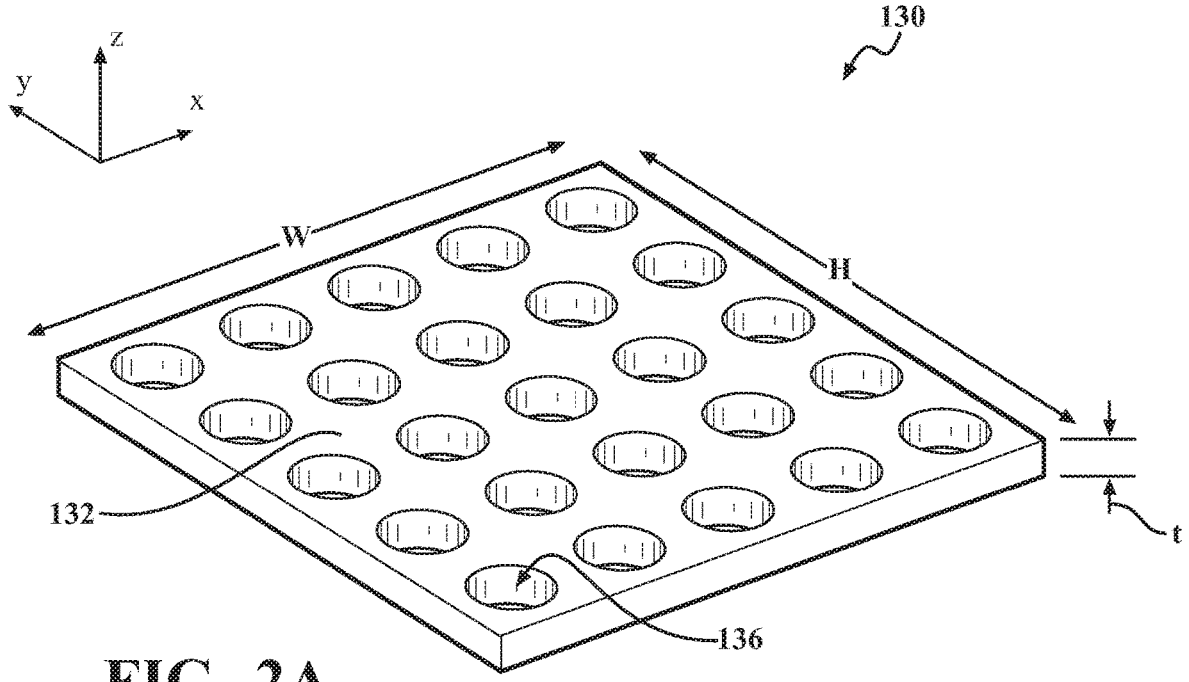
FIGS. 2A and 2B are a perspective view and a partially transparent perspective view, respectively, of an optional top plate of the array of FIG. 1A.
Figure 2B:
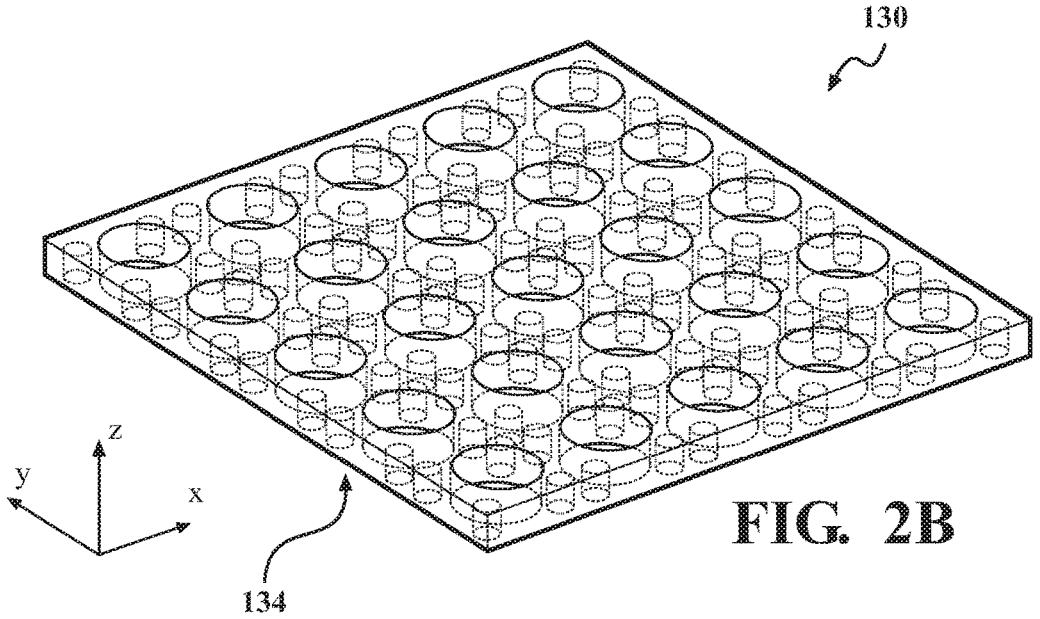

FIGS. 2A and 2B show a perspective view and a partially transparent perspective view, respectively, of a top plate 130 used in the assembled array 100 of FIG. 1A. FIGS. 2C and 2D show a top plan view and a bottom plan view, respectively, of the top plate 130, with the bottom plan view of FIG. 2D including a magnified view of a unit cell 140 of the top plate 130. The plate 130 has a top surface 132 and a bottom surface 134, and includes a 5×5 periodic array of apertures 136, each aperture 136 passing from the top surface 132 to the bottom surface 134. Each aperture 136 in the top plate 130 corresponds to a resonance chamber 118 of the array 100. The top plate 130 can thus function to provide the open end 116 of each open-ended resonance chamber 118, and further to hold the various tube resonators 110 together laterally. The bottom surface of the top plate 130, seen directly in the view of FIG. 2D, highlights one unit cell 140 from among an array of unit cells 140. Each unit cell 140 includes an aperture 136 and four female connector elements 142. The aperture 136 extends between the top and bottom surfaces 132, 134 of the top plate 130, while the female connector elements 142 are constituted by receptacles or depressions in the bottom surface 134 of the top plate 130. The top plate 130 can be described with, at least, the following geometric parameters, illustrated in FIGS. 2A, 2C, and 2D, with the quantitative dimensions of an exemplary embodiment shown in parentheses:

- Overall plate 130 width, W (50 mm);
- Overall plate 130 height, H (50 mm);
- plate 130 thickness, t (3 mm);
- unit cell 140 width, w (10 mm);
- unit cell 140 height, h (10 mm);
- center-to-center distance between adjacent unit cells 140 in the x-dimension, $d_x$ (10 mm);
- center-to-center distance between adjacent unit cells 140 in the y-dimension, $d_y$ (10 mm);
- radius of the aperture 136, R1 (3.5 mm);
- radius of the female connector element 142, R2 (1 mm);
- depth of female connector element 142, D (2 mm) [not labeled in drawings];
- center-to-center distance between aperture 136 and female connector element 140, in the x-dimension, $c_x$ (3.5 mm); and
- center-to-center distance between aperture 136 and female connector element 140, in the y-dimension, $c_y$ (3.5 mm).

It will be understood that the exemplary dimensions provided above are not exclusive, but are provided as references for exemplary functional data discussed below. Furthermore, the specific shapes shown in FIGS. 1A and 2A-2D can be varied. In particular, the unit cells 140, apertures 136, and female connector elements 142 are shown as being square, circular, and circular, respectively. However, any of these elements can alternatively be circular, elliptical, square, rectangular, triangular, or other polygonal. For ease of assembly, it will be preferred in some variations that the female connector elements 142 be circular and that the unit cells 140 have a polygonal shape with at least one degree of rotational symmetry.

Figure 3A:
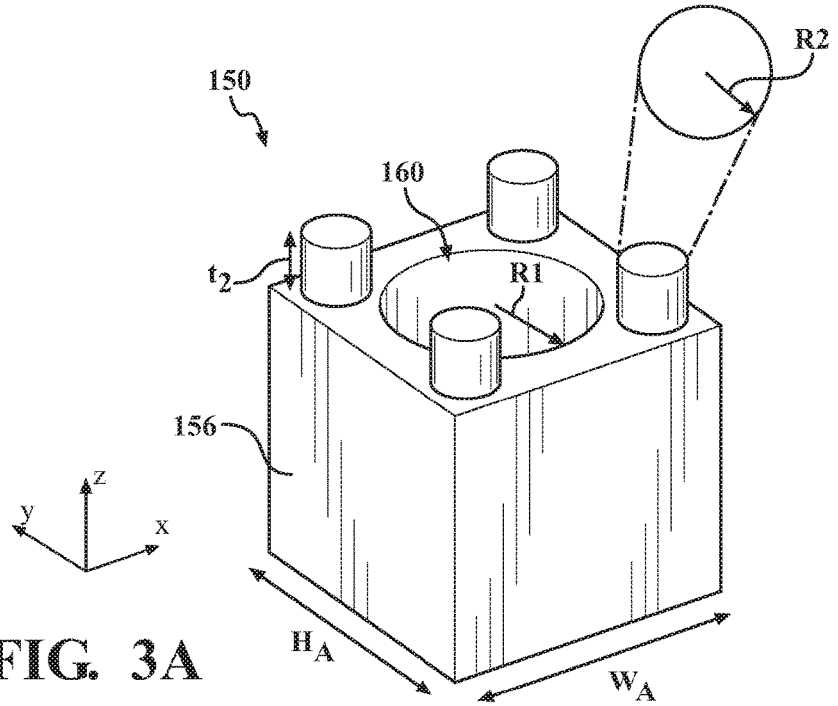
FIGS. 3A-3C are a perspective view, a transparent perspective view, and a sectional perspective view, respectively, of a straight channel block used in a disclosed system for building modular tube resonators.
Figure 3B:
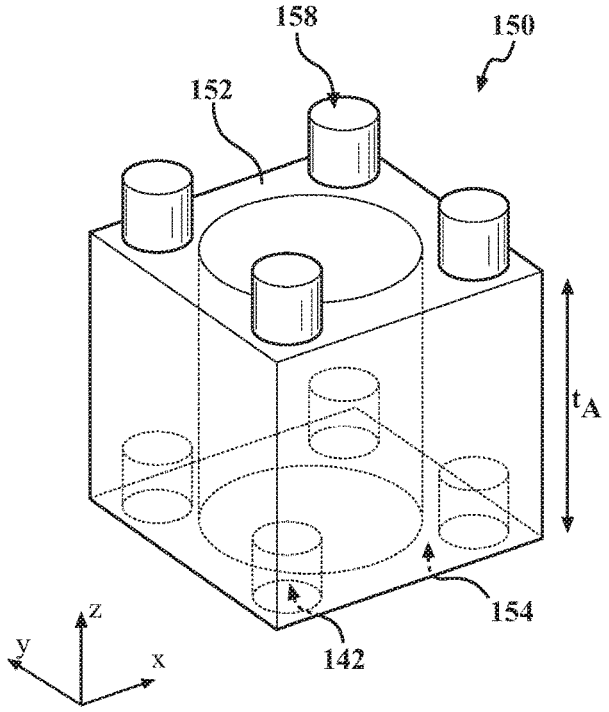
Figure 3C:
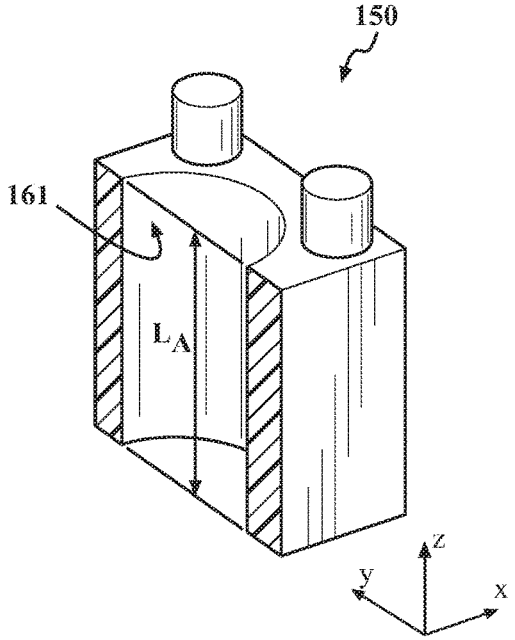
Figure 3D:
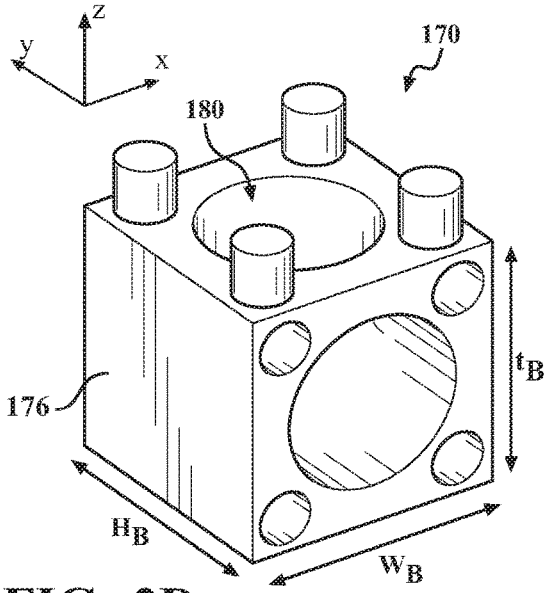
FIGS. 3D-3F are a perspective view, a transparent perspective view, a sectional perspective view, respectively, of a curved channel block used in a disclosed system for building modular tube resonators.
Figure 3E:
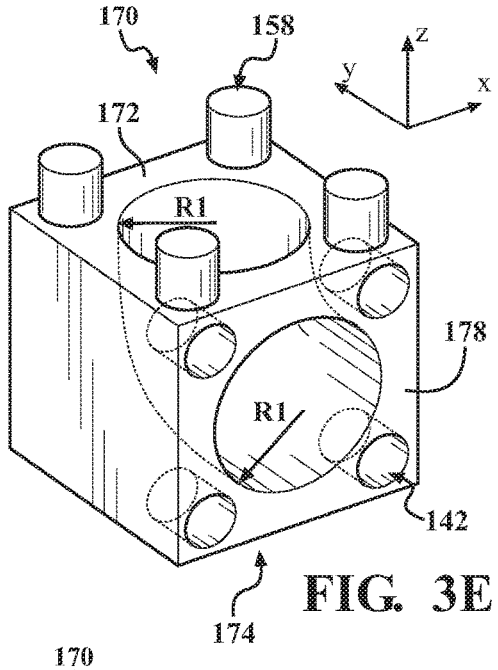
Figure 3F:
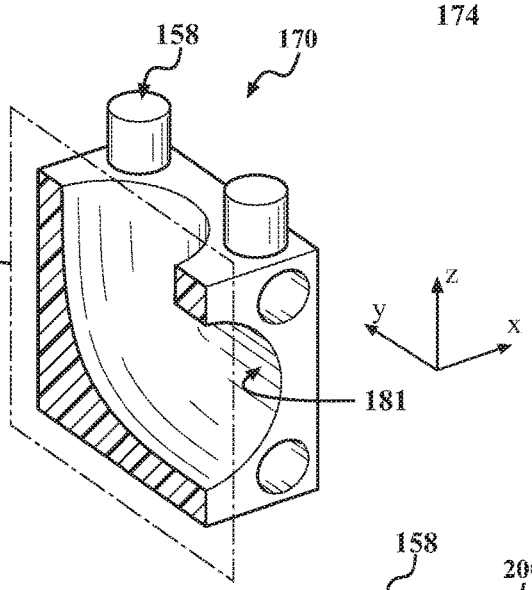
Figure 3G:
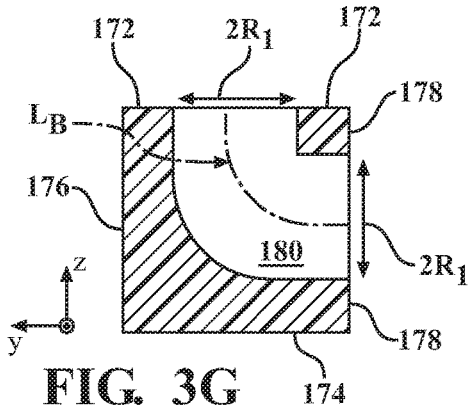
FIG. 3G is a side view of a sectional slice of the curved channel block of FIGS. 3D-3F, the outline of the sectional slice shown in FIG. 3F.
Figure 3H:
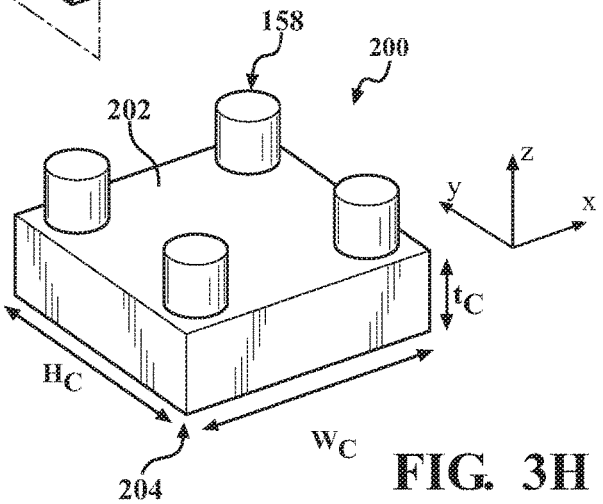
FIG. 3H is a perspective view of a terminator block used in the system for building modular tube resonator structures.

FIG. 3A-3H shows various views of three exemplary of blocks that can be used in building an array 100 of the type shown in FIG. 1A, and/or in building individual tube resonators 110. FIGS. 3A and 3B show a perspective view and a partially transparent perspective view, respectively, of a straight channel block 150 (alternatively referred to as a "Type A" block), and FIG. 3C shows a perspective view of half of the Type A block 150, to further facilitate a view of the block 150 interior. FIGS. 3D and 3E show a perspective view and a partially transparent perspective view, respectively, of a curved channel block 170 (alternatively referred to as a "Type B" block), and FIG. 3F shows a perspective view of half of the Type B block 170. FIG. 3G shows a side cross-sectional view of the Type B block 170, viewed along the line 3G-3G of FIG. 3F. FIG. 3H shows a perspective view of a terminator block 200 (alternatively referred to as a "Type C" block 200).

With reference to FIGS. 3A-3C, the Type A block 150 has a top surface 152 and a bottom surface 154 opposite the top surface 152. Four side surfaces 156 connect the top and bottom surfaces 152, 154. The bottom surface 154 includes four female connector elements 142, as described above. The top surface 152 includes four male connector elements 158, each male connector element 158 constituted of a stud or protrusion complementary to a female connector element 142, and configured to reversibly mate with a female connector element 142, thereby reversibly holding adjacent blocks (e.g. 150) in contact with one another. The male connector elements 158 can be characterized by a radius, that is generally the same as radius $R_2$ of the female connector elements 142, and by a thickness, $t_2$, that is generally the same as the depth, D, of the female connector elements 142.

The straight channel block 150 further includes a straight channel 160, formed by at least one internal side wall. The straight channel passes through the interior of the straight channel block 150, and forms apertures on the top and bottom surfaces 152, 154. As will be seen below, the at least one internal side wall 161 can form a portion of the side wall 112 of a tube resonator 110, and the straight channel 160 can form a portion of the resonance chamber 118 of a tube resonator 110, when fully assembled. The straight channel block 150 can be described with, at least, the following geometric parameters, illustrated in FIGS. 3A-3C, with the quantitative dimensions of an exemplary embodiment shown in parentheses:

straight channel block 150 width, $W_A$ (10 mm);
straight channel block 150 height, $H_A$ (10 mm);
straight channel block 150 thickness, $t_A$ (10 mm);
straight channel 160 radius equals $R_1$ (3.5 mm);
male connector element 158 radius $R_2$ (1 mm)
male connection thickness 158 $t_2$ (2 mm).

The straight channel block 150 can further be characterized by a straight channel length, $L_A$, which is generally equal to the straight channel block thickness, $t_A$.

The curved channel block 170 of FIGS. 3D-3G has a top surface 172 and a bottom surface 174, opposite the top surface 172. The curved channel, or Type B, block 170 further includes three side surfaces 176 and one coupling side surface 178. A curved channel 180, formed by an internal side wall 181, runs through the block 170 interior and forms an aperture in the top surface 172 and in the coupling side surface 178.

The dimensions of the curved channel block 170 can be generally the same as those of the straight channel block 150, with the exception that the curved channel 180 forms apertures in, and the female connector elements reside in, the coupling side surface 178 rather than on the bottom surface 174 of the Type B block 170. In the exemplary embodiment:

curved channel block 170 width, $W_B$ (10 mm);
curved channel block 170 height, $H_B$ (10 mm);
curved channel block 170 thickness, $t_B$ (10 mm);
curved channel 180 radius equals $R_1$ (3.5 mm).

The curved channel also has a length, $L_B$, measured as a curved line passing through the geometric center of the curved channel, from the aperture in the top surface 172 to the aperture in the side surface 178. FIG. 3F is a sectional slice of the curved channel block 170 of FIG. 3D. FIG. 3G shows a dashed-dotted line representing the curved channel length, $L_B$. In the exemplary embodiment of the present teachings, $L_B$ is 8.5 mm. In some variations, the curved channel 180 can be angled rather than curved. As such, the curved channel 180 can alternatively be referred to as a nonlinear channel 180 and the curved channel, or Type B, block 170 can alternatively be referred to as a nonlinear channel block 170.

The terminator (Type C) block 200 of FIG. 3H has a top surface 202 and a bottom surface 204 opposite the top surface 202. Four side surfaces connect the top and bottom surfaces 202, 204. Four male connector elements 158 are arrayed on the top surface 202, and configured to mate with the female connector elements 142 of either a straight channel bottom surface 154 or a coupling side surface 178. In a present example, the terminator block has:

terminator block 200 width, $W_C$ (10 mm);
terminator block 200 height, $H_C$ (10 mm);
terminator block 200 thickness, $t_C$ (3 mm);

It will be apparent that individual tube resonators 110 can be formed by connecting Type A and/or Type B blocks 150,170 together in series and then capping the series of blocks with a terminator block 200. The tube resonator 110 so formed will have at least one side wall 112 formed by the internal side walls 161, 181 of the series of Type A and/or Type B blocks 150,170, and end wall 114 formed by the top surface 202 of the terminator block 200. It will be understood that the resonance chambers 118 of tube resonators 110 so formed will have a length, L, according to equation 2:

$$L=(N_A \times L_A)+(N_B \times L_B)+(N_P \times t) \quad \text{Eq. 2,}$$

Where $N_A$ is the number of Type A blocks 150 in the tube resonator 110, $N_B$ is the number of Type B blocks 170 in the tube resonator 110, and $N_P$ is the number of top plates in the tube resonator (where $N_P$ will generally be zero or one). It will be understood that, in some implementations, there can be Type A, Type B, and/or Type C blocks of different dimensions. For example, a given build or "kit" can include Type A blocks having different thicknesses, $t_A$, and correspondingly, different straight channel 160 lengths, $L_A$.

It will be understood that, in some implementations in which multiple tube resonators 110 are clustered in an array 100, a terminator block 200 having sufficiently large Height, $H_C$, and width, $W_C$, can connect to multiple tube resonators 110 simultaneously. In some such implementations, a terminator block 200 can hold together multiple tube resonators 110 of an array, so that a top plate 130 is not needed to hold tube resonators 110 together, although it still may be useful to cover connector elements, such as male connector elements 158. In some implementations, an array 100 can have a top plate 130 and a terminator block 200 that connects to multiple tube resonators 110.

Figure 4B:
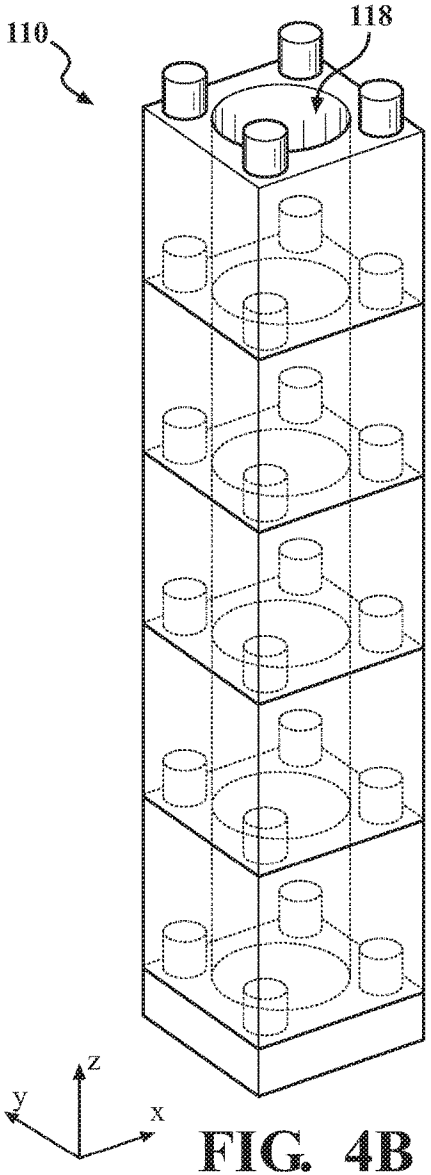
FIGS. 4A-4B are a perspective view and partially transparent perspective view of a straight tube resonator of the present teachings.
Figure 4A:
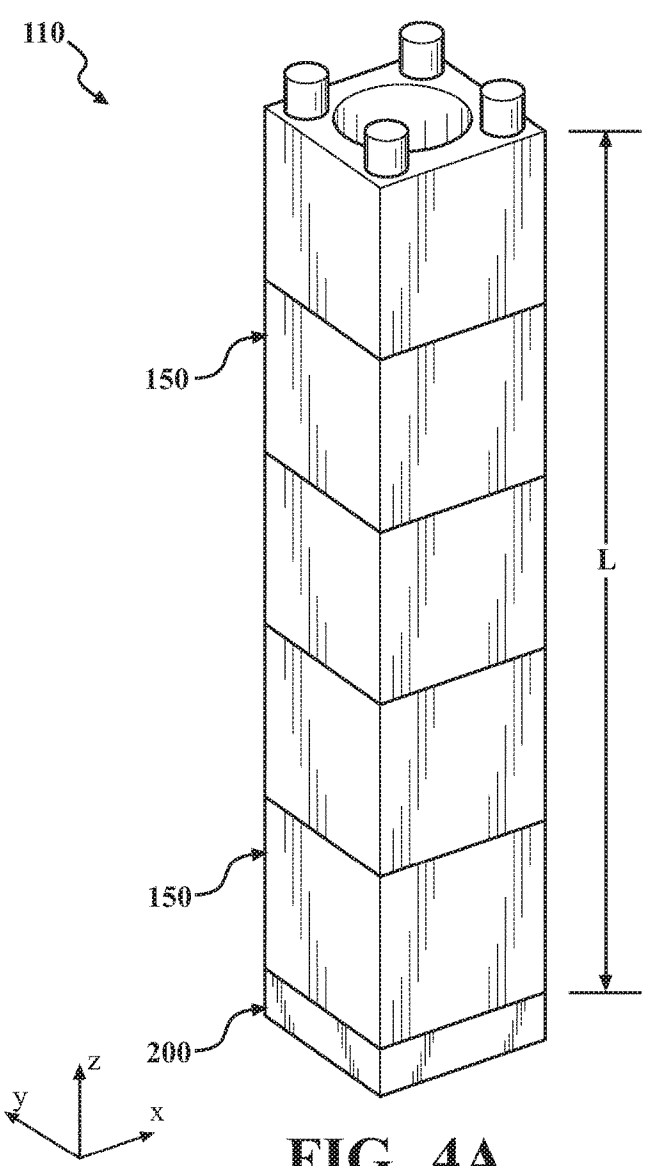

FIGS. 4A and 4B show a perspective view and a semi-transparent perspective view, respectively, of an exemplary tube resonator 110 built from five Type A blocks 150, capped with a Type C block 200. The resonator 110 and resonance chamber 118 are therefore straight, and the latter has a length, L, equal to ($5\times L_A$), or 50 mm if using the exemplary dimensions provided above.

Figure 5C:
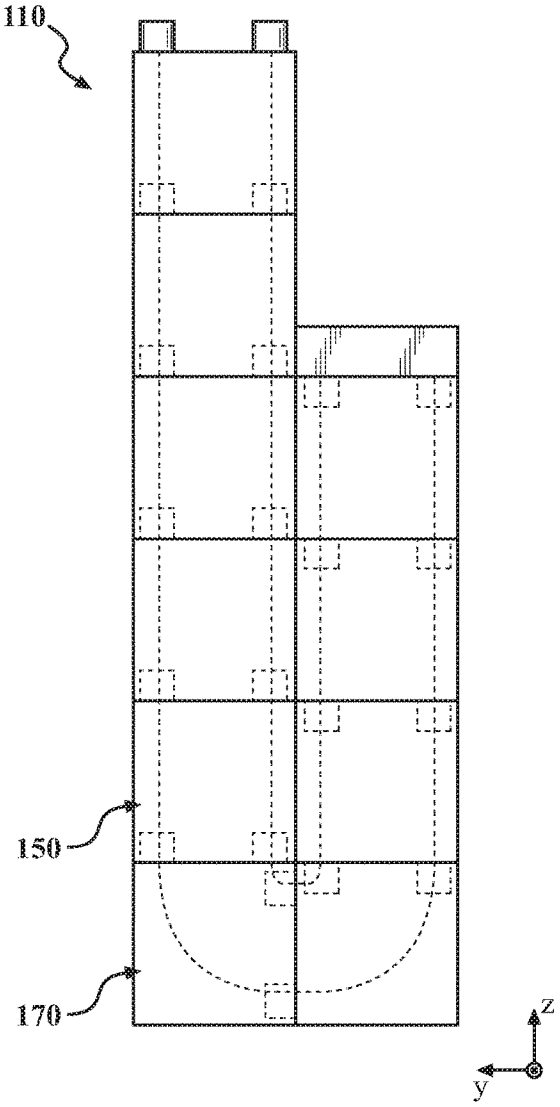
FIGS. 5A-5C are a perspective view, a semi-transparent perspective view, and a side plan view, respectively, of a tube resonator of the present teachings having a 180° bend.
Figure 5B:
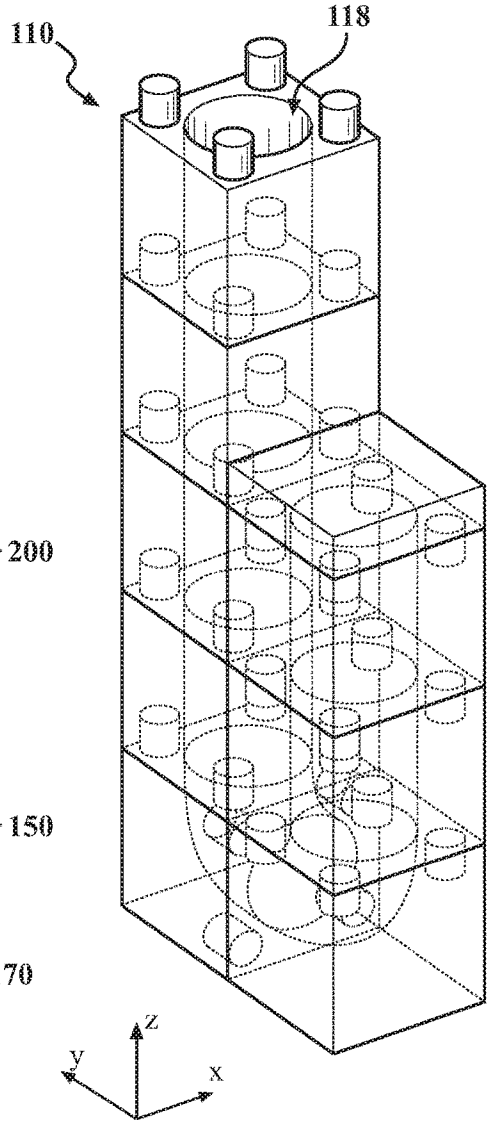
Figure 5A:
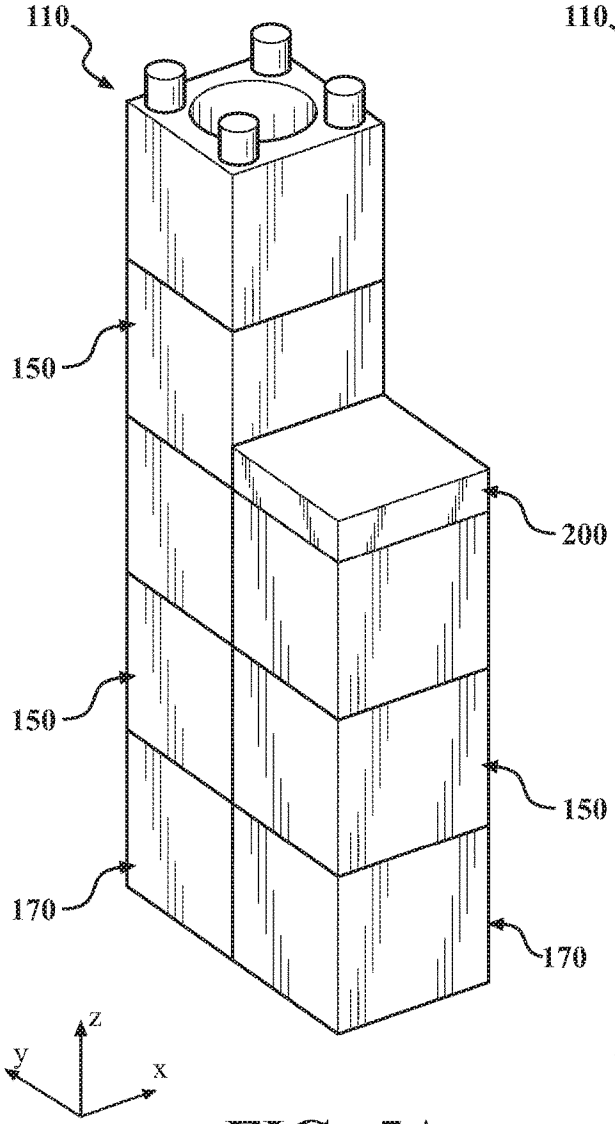

FIGS. 5A-5C show a perspective view, a semi-transparent perspective view, and a semi-transparent side plan view, respectively, of an alternative exemplary tube resonator 110 having a 180° bend. The resonator 110 of FIGS. 5A-5C includes four consecutive Type A blocks, two consecutive Type B blocks 170, and another two Type A blocks 150 prior to the terminator block 200. The resonator 110 and resonance chamber 118 therefore have two straight regions with a 180° intervening bend, and the resonance chamber 118 has a length, L, equal to $[(8\times L_A)+(2\times L_B)]$, or 97 mm if using the exemplary dimensions provided above.

Figure 6C:
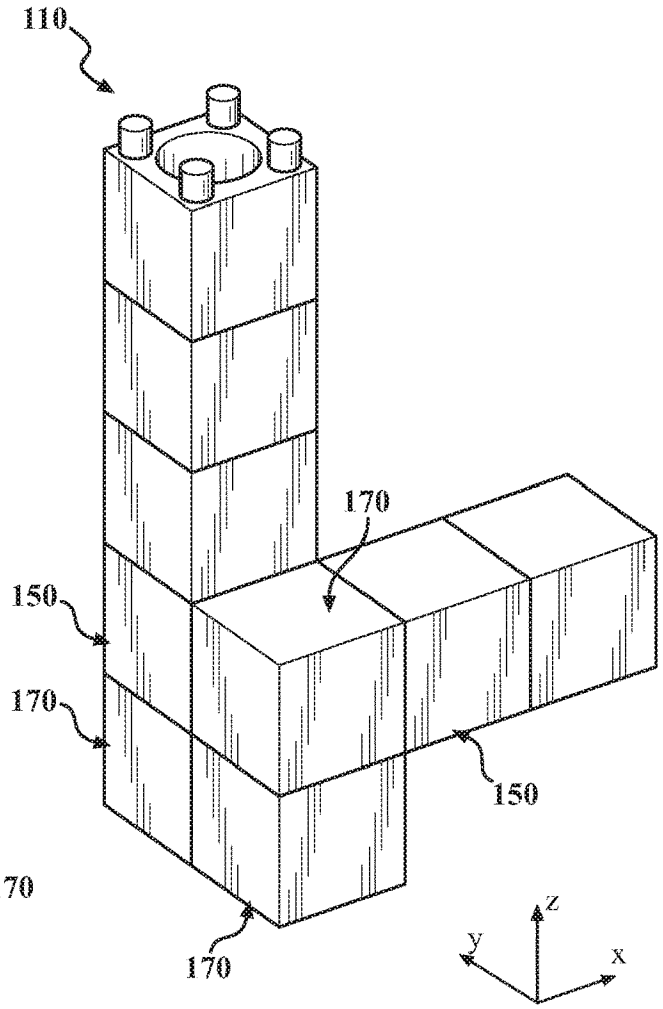
FIGS. 6A-6C are perspective views of three alternative configurations of tube resonators of the present teachings.
Figure 6B:
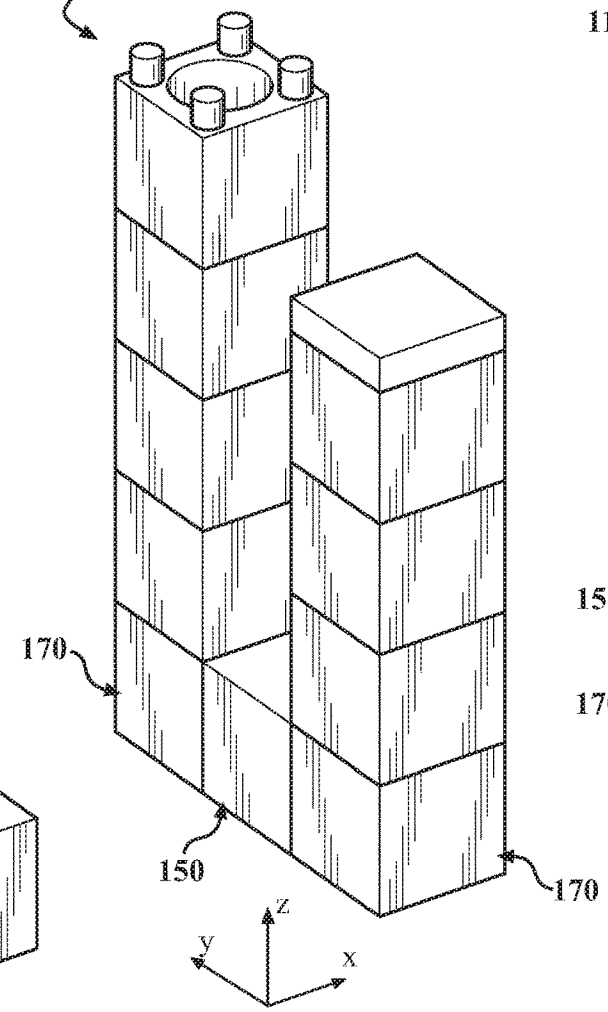
Figure 6A:
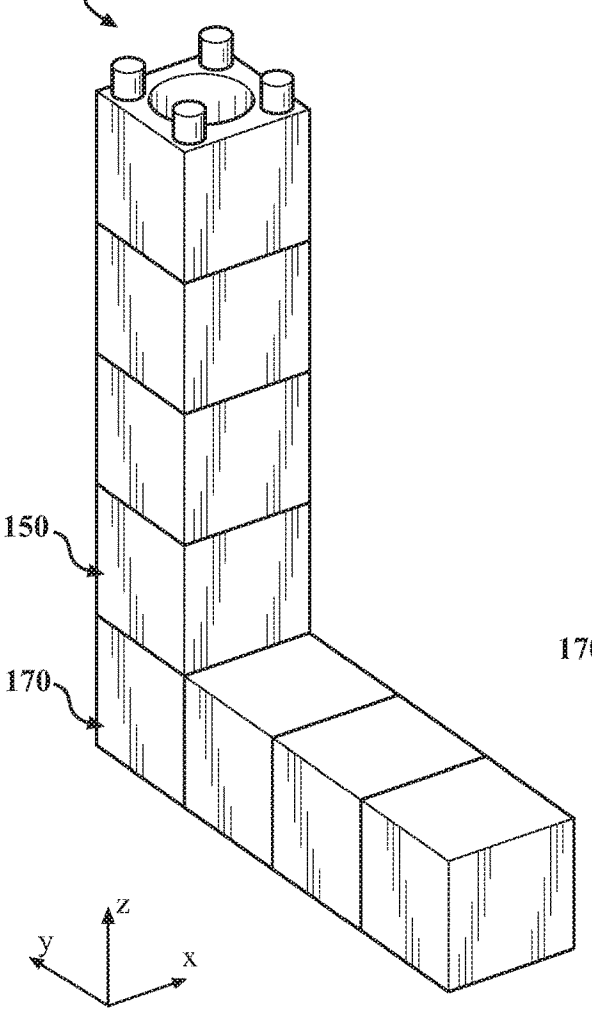

FIGS. 6A-6C show perspective views of three other example configurations. These include: (i) a tube resonator 110 having a single Type B block between series of Type A blocks, producing a 90° bend (FIG. 6A); a resonator 110 having two 90° bends with an intervening straight portion (FIG. 6B); and a resonator having three consecutive Type B blocks 170 producing a 180° bend followed by an orthogonal 90° bend (FIG. 6C). It will be understood that a limitless number of lengths and configurations can be easily constructed using the disclosed interlocking blocks. The resonance chamber 118 lengths, L, of these resonators 110 are, using the exemplary dimensions provided above, 68.5 mm, 97 mm, and 75.5 mm, respectively.

It will be noted that the exemplary resonators 110 of FIGS. 4A-4B, 5A-5C, and 6A-6C do not have top plates 130, although top plates 130 could optionally be added, with a consequent increase in resonance chamber 118 length. Further, while the exemplary structures of the various plates 130 and blocks 150, 170, 200 described herein are rectangular prisms (in the case of top plate 130 and terminator block 200) and cubes in the case of Type A/B blocks 150, 170, the external shapes of these structures can vary. For example, Type A and Type B blocks 150, 170 will generally have the same shape and dimensions as one another, but can be rectangular prisms, other polygonal prisms, cylindrical, etc. Similarly while channels 160, 180 are shown as being cylindrical (or curved cylindrical in the case of a curved channel 180), they can similarly have a polygonal prismatic shape. It may be anticipated that cubic or rectangular prismatic shapes of Type A and B blocks 150, 170 will provide greater ease of assembly, particularly when the resulting tube resonators 110 are incorporated into a multi-tube array 100.

In various implementations, the various plates and blocks 130, 150, 170, 200 described herein will typically be formed of a solid, sound reflecting material. In general, such a material or materials will be rigid and will have acoustic impedance higher than that of ambient fluid 105. Such materials can include a thermoplastic resin, such as polyurethane, a ceramic, a metal, or any other suitable material.

Further, it will be understood that the deployment of male and female connector elements 158, 142 does not have to be as shown, but can instead be reversed. The connector elements 158, 142 do not necessarily need to be conventionally "male" and "female" type, formed of protrusions and receptacles, but will generally be complementary connectors configured to couple with one another. As such, they can alternatively be referred to as "first type connector elements" 158 and "second type connector elements" 142. In an exemplary alternative variation, a first type connector element 158 could be a magnet embedded in a relevant block 150, 170, 200 surface with north polarity facing outward, and a second type connector element 158 could be a magnet embedded in a relevant block 150, 170, 200 surface with south polarity facing outward.

FIGS. 7A and 7B show simulated acoustic response data (reflection and absorption as a function of frequency) for the tube resonators 110 of FIGS. 4A-4B and FIGS. 5A-5C, respectively. The results show the clear correlation between resonance frequency and channel length, and confirm that acoustic reflection rapidly disappears and is replaced by absorption near the resonance frequency. Unity absorption is achieved at the resonance frequency by the straight resonator of FIGS. 4A-4B at about the predicted resonance frequency of 1620 Hz, and near unit absorption is achieved by the bent channel resonator of FIGS. 5A-5C at about the predicted resonance frequency of 860 Hz.

Figure 8:
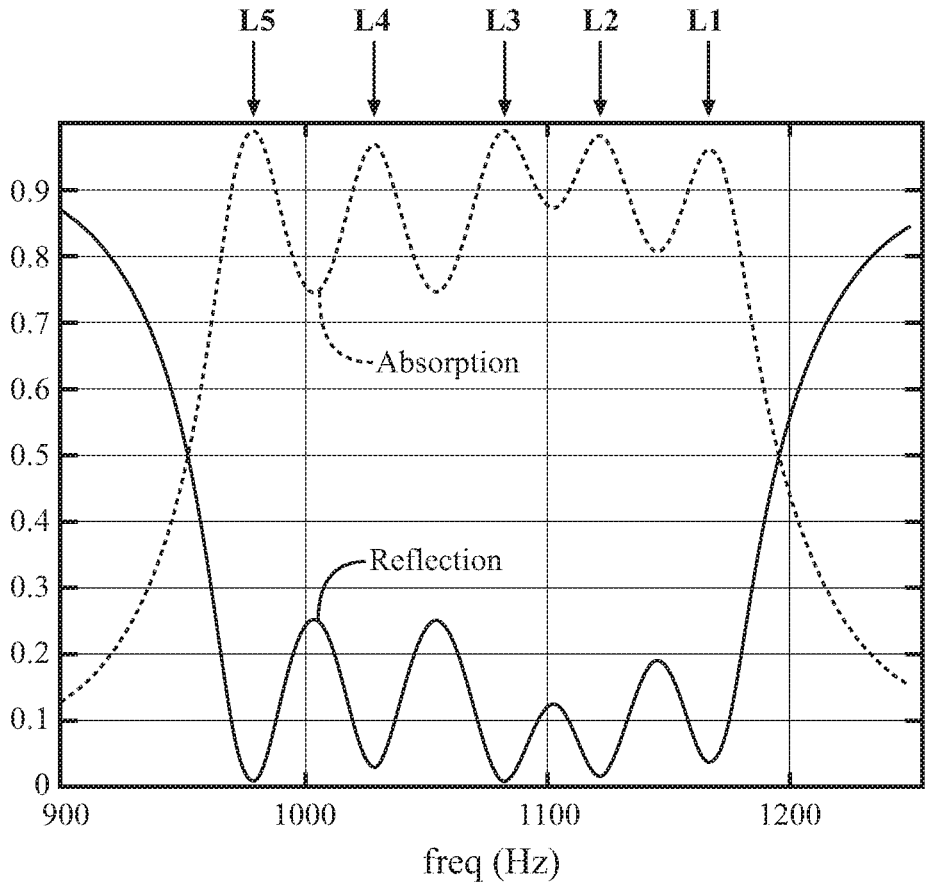
FIG. 8 is a plot of acoustic reflection and absorbance vs. frequency for a 5×1 array of tube resonators of the present teachings, where the five resonators of the array have five different lengths.

FIG. 8 shows simulated acoustic response data for a channel array structure of the type shown in FIG. 1A, having channels of five different lengths within the array. The five resonators have resonance chamber 118 lengths of: 70 mm, 73 mm, 76 mm, 80 mm and 83 mm. It will be noted that these resonance chamber 118 lengths are constructed with Type A blocks 150 having the exemplary dimensions given above, with the exception of the 76 mm long resonance chamber 118 having an additional Type A block with a thickness, $t_A$, of 3 mm. The data show five distinct, but partially overlapping, absorption peaks, corresponding to the five resonance frequencies of the five chamber 1181 lengths, and an overall broad absorption spectrum. This result confirms the utility of the customizable blocks in building broadband absorption structures from arrays having multiple resonance frequencies.

The preceding description is merely illustrative in nature and is in no way intended to limit the disclosure, its application, or uses. As used herein, the phrase at least one of A, B, and C should be construed to mean a logical (A or B or C), using a non-exclusive logical "or." It should be understood that the various steps within a method may be executed in different order without altering the principles of the present disclosure. Disclosure of ranges includes disclosure of all ranges and subdivided ranges within the entire range.

The headings (such as "Background" and "Summary") and sub-headings used herein are intended only for general organization of topics within the present disclosure, and are not intended to limit the disclosure of the technology or any aspect thereof. The recitation of multiple embodiments having stated features is not intended to exclude other embodiments having additional features, or other embodiments incorporating different combinations of the stated features.

As used herein, the terms "comprise" and "include" and their variants are intended to be non-limiting, such that recitation of items in succession or a list is not to the exclusion of other like items that may also be useful in the devices and methods of this technology. Similarly, the terms "can" and "may" and their variants are intended to be non-limiting, such that recitation that an embodiment can or may comprise certain elements or features does not exclude other embodiments of the present technology that do not contain those elements or features.

The broad teachings of the present disclosure can be implemented in a variety of forms. Therefore, while this disclosure includes particular examples, the true scope of the disclosure should not be so limited since other modifications will become apparent to the skilled practitioner upon a study of the specification and the following claims. Reference herein to one aspect, or various aspects means that a particular feature, structure, or characteristic described in connection with an embodiment or particular system is included in at least one embodiment or aspect. The appearances of the phrase "in one aspect" (or variations thereof) are not necessarily referring to the same aspect or embodiment. It should be also understood that the various method steps discussed herein do not have to be carried out in the same order as depicted, and not each method step is required in each aspect or embodiment.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations should not be regarded as a departure from the disclosure, and all such modifications are intended to be included within the scope of the disclosure.

What is claimed is:

1. A modular acoustic sound absorber, the sound absorber comprising:

a plurality of tube resonators forming an array of tube resonators, each tube resonator of the plurality of tube resonators comprising:

an open end, an end wall, a length L defined as a distance between the open end and the end wall, the length L having a uniform diameter, and a resonance frequency, $f_0$, described by the equation:

$$f_0 = \frac{c}{4L}$$

wherein c is the speed of sound in an ambient fluid;

a plurality of straight channel blocks having an exterior shape, each straight channel block having:

a top surface comprising one or more first type connector elements; and a bottom surface, parallel to and opposite the top surface, and comprising one or more second type connector elements configured to engage with the one or more first type connector elements of an adjacent block;

one or more side surfaces connecting the top and bottom surfaces; and a straight channel forming apertures in the top and bottom surfaces and passing through an interior of the straight channel block and thereby forming at least a portion of each tube resonator; and a plurality of terminator blocks forming the end wall of each tube resonator.

2. The sound absorber as recited in claim 1, wherein at least one tube resonator of the plurality of tube resonators comprises:

one or more nonlinear channel blocks having the exterior shape, each nonlinear channel block having:

a top surface comprising one or more first type connector elements;

a bottom surface parallel to and opposite the top surface;

a coupling side surface, connecting the top and bottom surfaces, and having one or more second type connector elements; and a nonlinear channel forming apertures in the top surface and the coupling surface, and passing through an interior of the nonlinear channel block and thereby forming at least a portion of the at least one tube resonator.

3. The sound absorber as recited in claim 1, wherein at least two of the plurality of tube resonators have a different length, L.

4. The sound absorber as recited in claim 1, wherein the exterior shape is a polygonal prism.

5. The sound absorber as recited in claim 1, wherein the exterior shape is a cube.

6. The sound absorber as recited in claim 1, further comprising a top plate having:

a smooth top surface;

a bottom surface opposite the top surface and including a plurality of second type connector elements; and a plurality of apertures passing through the top and bottom surfaces, each aperture of the plurality corresponding to a tube resonator of the plurality of tube resonators.

7. The sound absorber as recited in claim 1, wherein the first and second type connector elements comprise male and female connector elements, respectively, or vice-versa.

8. A modular quarter-wavelength resonator, comprising:

an open end, a terminator block forming an end wall of the quarter-wavelength resonator, a length L defined as a distance between the open end and the end wall, the length L having a uniform diameter, and a resonance frequency, $f_0$, described by the equation:

$$f_0 = \frac{c}{4L}$$

wherein c is the speed of sound in an ambient fluid; and a plurality of straight channel blocks of an exterior shape, each straight channel block having:

a top surface comprising one or more first type connector elements; and a bottom surface, parallel to and opposite the top surface, and comprising one or more second type connector elements, configured to engage with the one or more first type connector elements;

at least one side surface connecting the top and bottom surfaces; and a straight channel forming apertures having the uniform diameter in the top and bottom surfaces and passing through an interior of the plurality of straight channel blocks and thereby forming at least a portion of the quarter-wavelength resonator.

9. The quarter-wavelength resonator as recited in claim 8, further comprising one or more nonlinear channel blocks of the exterior shape, each nonlinear channel block having:

a top surface comprising one or more first type connector elements;

a bottom surface parallel to and opposite the top surface;

a coupling side surface connecting the top and bottom surfaces, and having one or more second type connector elements; and a curved channel, forming apertures in the top surface and the coupling side surface, and passing through an interior of the nonlinear channel block and thereby forming at least a portion of the resonator.

10. The quarter-wavelength resonator as recited in claim 9, wherein the straight channel is a cylinder, the nonlinear channel is a curved cylinder, and the straight and nonlinear channels have identical radius.

11. The quarter-wavelength resonator as recited in claim 8, wherein the first and second type connector elements comprise magnets of opposite polarity orientation.

12. The quarter-wavelength resonator as recited in claim 8, wherein the exterior shape is cubic.

13. The quarter-wavelength resonator as recited in claim 8, wherein the first and second type connector elements comprise male and female connector elements, respectively, or vice-versa.

14. A kit for assembling a modular, quarter-wavelength resonator, the kit comprising:

a plurality of Type A blocks, each Type A block having:

a top surface comprising one or more first type connector elements; and a bottom surface, parallel to and opposite the top surface, and comprising one or more second type connector elements configured to engage with the one or more first type connector elements of an adjacent block;

one or more side surfaces connecting the top and bottom surfaces; and a straight channel forming apertures in the top and bottom surfaces and passing through an interior of the Type A block, configured to form at least a portion of a quarter-wavelength resonator;

a plurality of Type B blocks, each Type B block having:

a top surface comprising one or more first type connector elements;

a bottom surface parallel to and opposite the top surface;

a coupling side surface, connecting the top and bottom surfaces, and having one or more second type connector elements; and a nonlinear channel forming apertures in the top surface and the coupling surface, and passing through an interior of the Type B block, continued to form at least a portion of a quarter-wavelength resonator; and one or more Type C blocks having a top surface and a bottom surface opposite the top surface, and one or more first type connector elements on the top surface, wherein Type A and Type B blocks are configured to be connected in series, the series capped with a Type C block, the capped series forming the quarter-wavelength resonator, with a combination of straight channels and nonlinear channels from the series forming a resonance chamber with an open end, an end wall, a length L defined as a distance between the open end and the end wall, the length L having a uniform diameter, and a resonance frequency, $f_0$, described by the equation:

$$f_0 = \frac{c}{4L}$$

wherein c is the speed of sound in an ambient fluid, and the top surface of the Type C block forming the end wall.

15. The kit as recited in claim 14, wherein Type A, Type B, and Type C blocks are configured to be reversibly connected via engagement of the first type connector elements with the second type connector elements.

16. The kit as recited in claim 14, wherein the first and second type connector elements comprise male and female connector elements, respectively, or vice-versa.

17. The kit as recited in claim 14, wherein the first and second type connector elements comprise magnets of opposite polarity orientation.

18. The kit as recited in claim 14, wherein the straight channel is cylindrical and the nonlinear channel is curved cylindrical.

19. The kit as recited in claim 14, further comprising a top plate having:

a smooth top surface;

a bottom surface opposite the top surface and including a plurality of second type connector elements; and a plurality of apertures passing through the top and bottom surfaces, wherein the top plate is configured to hold a plurality of quarter-wavelength resonators in an array, and each aperture of the plurality of apertures is configured to correspond to a resonance chamber of the array.

* * * * *